US007056148B2

(12) United States Patent
Staniszewski et al.

(10) Patent No.: US 7,056,148 B2
(45) Date of Patent: Jun. 6, 2006

(54) ELECTRICAL TERMINAL CONNECTION, ESPECIALLY FOR CONNECTING AN OUTER CONDUCTOR OF A COAXIAL CABLE

(75) Inventors: Walter Staniszewski, Aschau (DE); Ralf Hantsch, Raubling (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/533,815

(22) PCT Filed: Oct. 30, 2003

(86) PCT No.: PCT/EP03/12102

§ 371 (c)(1),
(2), (4) Date: May 27, 2005

(87) PCT Pub. No.: WO2004/057708

PCT Pub. Date: Jul. 8, 2004

(65) Prior Publication Data

US 2005/0272278 A1 Dec. 8, 2005

(30) Foreign Application Priority Data

Dec. 19, 2002 (DE) ..... 102 59 803

(51) Int. Cl.
*H01R 4/24* (2006.01)

(52) U.S. Cl. ..... 439/444

(58) Field of Classification Search ..... 439/63, 439/578, 579, 581, 320, 322, 306, 95; 174/65 R, 174/151, 152 R See application file for complete search history.

(56) References Cited

U.S. PATENT DOCUMENTS 3,622,939 A * 11/1971 Forney, Jr. ..... 439/322
3,725,849 A * 4/1973 Becke ..... 439/363
3,845,453 A * 10/1974 Hemmer ..... 439/578
4,469,390 A * 9/1984 LeVine et al. ..... 439/394
4,540,231 A * 9/1985 Forney, Jr. ..... 439/306
5,145,408 A 9/1992 Houtteman et al.

(Continued)

FOREIGN PATENT DOCUMENTS

DE 2022318 5/1970

(Continued)

*Primary Examiner*—Hae Moon Hyeon
*Assistant Examiner*—Harshad C Patel
(74) *Attorney, Agent, or Firm*—Nixon & Vanderhye P.C.

(57) ABSTRACT

The invention relates to an electrical terminal connection, especially for connecting an outer conductor of a coaxial cable, characterized by the following novel developments: the electrical terminal connection is embodied in a two-stage manner; the plug-in element comprises at least two plug-in sections which are staggered in the plug-in and axial direction, both the first plug-in section in the plug-in direction and the following plug-in section being provided with a knurl on the outer periphery thereof; the receiving opening comprises a first receiving section and a second receiving section which are staggered in the plug-in and axial direction of the plug-in element; and the cross-sectional size of the two plug-in sections and the two complementary receiving sections differs in that the radial dimension or outer dimension of the plug-in sections provided with the knurl is slightly larger than the radial or outer dimension of the receiving section respectively co-operating therewith.

17 Claims, 6 Drawing Sheets

U.S. PATENT DOCUMENTS

Figure 1:
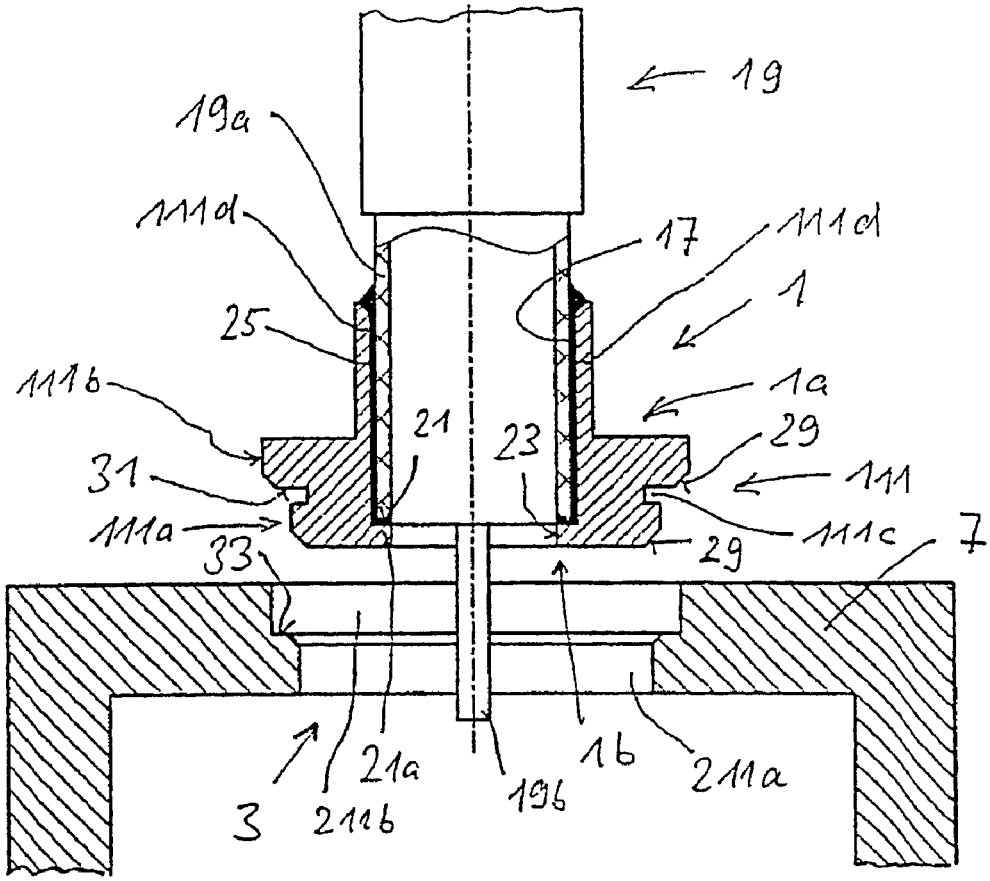

| | | | | |
|---|---|---|---|---|
| 5,580,276 | A | 12/1996 | Mussen | |
| 6,231,357 | B1 | 5/2001 | Rumsey | |
| 6,761,574 | B1 * | 7/2004 | Song et al. | 439/320 |
| 6,767,247 | B1 * | 7/2004 | Rodrigues et al. | 439/578 |
| 6,929,508 | B1 * | 8/2005 | Holland | 439/579 |
| 2001/0053633 | A1 | 12/2001 | Konda | |
| 2004/0248475 | A1 * | 12/2004 | Seminara et al. | 439/680 |
| 2005/0118853 | A1 * | 6/2005 | Starke et al. | 439/320 |

FOREIGN PATENT DOCUMENTS

| | | |
|---|---|---|
| DE | GM 73 35 171 U | 9/1973 |
| DE | 3620111 | 6/1986 |
| DE | G 92 16 192.8 | 11/1992 |
| DE | 198 24 808 | 6/1998 |
| EP | 1 087 466 | 9/2000 |

* cited by examiner

ELECTRICAL TERMINAL CONNECTION, ESPECIALLY FOR CONNECTING AN OUTER CONDUCTOR OF A COAXIAL CABLE

This application is the US national phase of international application PCT/EP2003/012102 filed 30 Oct. 2003, which designated the U.S. and claims benefit of DE 102 59 803.7, filed 19 Dec. 2002, the entire contents of each of which are hereby incorporated by reference.

The invention relates to an electrical terminal connection, especially for connecting an outer conductor of a coaxial cable in accordance with the preamble of claim 1.

Electrical terminal connections, especially for connecting an outer conductor of a coaxial cable, generally comprise a plug-in element which can be plugged into a socket or generally into a coupling having a corresponding plug accommodating opening.

Such coupling devices may also be formed, for example, on an electrically conductive metal part, a plate, a wall, i.e. generally a housing part or an electrically conductive housing, to which, for example, it is intended to connect an electrical coaxial cable. The inner conductor is insulated from the outer conductor and is in this case plugged into an inner conductor coupling part. The coaxial cable provided with a corresponding outer conductor sleeve in this case makes contact with a sleeve-like part of the coupling device in order to produce an electrical connection between the outer conductor of the coaxial cable and the plug-in element and, by means of this, generally with a housing or housing part.

When flexible coaxial cables are used which, as is known, are not capable of absorbing high torques or radial forces, various problems may, however, result. Firstly, it is not possible to realize a force-fitting connection between the outer conductor and, for example, an electrical housing without the use of additional parts.

On the basis of this, it has already been suggested, for example, in US 2001/0053633 A1, to press a plug-in element into an accommodating opening in a metallic wall. For this purpose, the end of a coaxial conductor generally has the insulation stripped from it in a corresponding manner, i.e. the insulation is also stripped from the outer conductor over a certain axial dimension, in order to position an adapter part there which is in the form of a metal sleeve. The distancing area between the inner wall of the sleeve-like adapter part and of the coaxial cable outer conductor is electrically connected by means of soldering. This adapter part is then pressed into a hole in a force-fitting manner, said hole being formed, for example, in an electrically conductive housing, housing part, an intermediate wall etc. The inner conductor may then protrude through the corresponding hole in the housing wall part into the interior and be electrically connected there using conventional means.

If castings are used in the case of such press-in connections, press-in sleeves having a corresponding outer knurl need to be used owing to high tolerances. In this case, the sleeves each have a radially protruding and circumferential ring which, in the pressed-in position, rests on the outer side of the wall with which electrical contact is to be made or of the stop etc. Since this stop surface, however, can never lie evenly (owing to irregularities of the corresponding stop wall, the misalignment of the pressing-in die etc.), no clear, unique electrical contact conditions can result which can always be reproduced, which is associated with all of the disadvantages emanating therefrom. In addition, there is the risk of slackening owing to relaxation and owing to thermal cycling.

DE 73 35 171 U discloses a device for connecting an outer conductor and for providing strain relief for a coaxial cable, it not being possible to see clearly from the figures whether the plug-in element is only plugged or even pressed into an accommodating opening.

Finally, however, electrical connection devices are also known, in particular for coaxial cables, in the case of which a contact bushing is placed onto the coaxial cable at the plug end over a certain axial length on an outer conductor region which has had the insulation stripped from it, said contact bushing in this case interacting with a union nut so as to produce axial forces. The union nut may be screwed onto a corresponding threaded attachment, which is, for example, formed on the housing wall with which contact is to be made. However, since the union nut may have a radial spacing, even if it is a minimum radial spacing, radially on the inside in the region in which the outer conductor sleeve of the coaxial cable is passed through, in this case likewise undefined electrical contacts result.

DE 198 24 808 C1 discloses a holder for elongate bodies having an electrical shield, said known holder having two accommodating sections, which lie offset with respect to one another and which have at least two associated plug-in sections which lie offset with respect to one another in the plug-in direction. The arrangement of the plug-in element in the accommodating opening in this case takes place by means of the plug-in element being pressed into the accommodating opening.

DE 20 22 318 B2 also discloses a tubular mounting element in the form of an electrical terminal connection for the purpose of inserting and fixing components for radio interference suppression in a manner which is resistant to high frequencies in shielding walls, which comprises a plug-in element which interacts with an accommodating opening formed in a housing wall. This plug-in element has at least two plug-in sections, which are formed so as to be offset in the plug-in and axial direction, which have different diameters and which are separated from one another in the axial direction by means of a circumferential groove. The plug-in section having the greater diameter has a knurl on its circumferential surface. For the purpose of producing the electrical connection, the plug-in element is pressed into the corresponding accommodating opening in the housing wall. During the pressing-in operation, the material of the housing wall is pressed into the groove of the plug-in element, which results in the plug-in element being fixed axially in the housing wall. In addition, the knurl is forced into the housing wall, which makes it possible to fix the plug-in element such that it is secured against rotation in the housing wall.

Finally, EP 1 087 466 A2 discloses a sleeve-like terminal connector having a plug-in element which interacts with an accommodating opening which is introduced into a housing wall. The plug-in element likewise has a knurl there on its circumferential surface.

Merely for reasons of completeness, mention is also made of the fact that naturally outer conductors of flexible coaxial cables, for example, can also be electrically connected to a housing by means of soldering. In principle, it is thus possible to produce a good electrical connection. However, consideration should be made of the fact that surfaces of cast housings cannot be soldered. It would first be necessary for the castings to be galvanized. This would lead, on the one hand, however, to considerable excess expense. Secondly, problems with quality owing to complex contours and uniform layer thicknesses would result. In addition, large quantities of heat would be required on soldering, which would lead to high thermal stresses on the housing and the cable.

If the mentioned electrical connection devices are provided in an electromagnetic field (for example an antenna), additional problems result which have hitherto been unknown. This is because, in this case, not only the current flow which can always be fixed on the inner side of the coaxial cable outer conductor is provided but, owing to the electromagnetic field, there is also a current flow on the outer side of the outer conductor.

If one of the abovementioned electrical connection devices which are known from the prior art is now chosen, this results in the current flowing on the inner side of the outer conductor being able to flow in a defined manner towards the inner side of the coupling element, but the current flowing on the outer side of the outer conductor not being able to flow towards the outer side of the coupling element. Owing to mechanical or thermal stresses, vibrations and jigging phenomena, the contact conditions are altered and interference signals occur.

It is therefore the object of the present invention to provide an improved electrical terminal connection, in the case of which electrical contact conditions, which are clearly defined and which can always be clearly reproduced, can be produced both between the inner side of the coaxial cable outer conductor and housing and between the outer side of the coaxial cable outer conductor and housing, to be precise in particular even when the electrical terminal connection is located in an electrical field.

The object is achieved according to the invention according to the features specified in claim 1.

Advantageous refinements of the invention are specified in the subclaims.

The improved electrical terminal connection is characterized by the fact that both the plug-in connection element, which is sometimes also referred to below as the plug-in element 1, and the associated coupling element, which is sometimes also referred to below as the accommodating opening, and into which the plug-in element can be inserted, are designed to have at least two stages in the axial plug-in direction. The plug-in element has, when viewed in the plug-in direction, a first plug-in section and, adjoining it in the axial direction (preferably lying at a spacing offset from said plug-in section), at least one second plug-in section which has a radially larger transverse extent than the first radial plug-in section, at least in partial circumferential regions. The coupling device is likewise designed to have two stages and to interact with it. In this case, the plug-in sections of the plug-in element are provided on their outer circumference with corresponding engaging elevations, i.e. a form of knurl, which has a radial or outer or distance dimension, before the plug-in connection is produced, which is at least slightly larger than the corresponding dimensions of the accommodating opening. When one part is pressed inside the other, an inner and an outer engagement zone is thus formed, namely an inner engagement zone with the interaction of the plug-in section, which has smaller dimensions, which leads in the plug-in direction and which interacts with a first and/or more inwardly lying and at least with a correspondingly matched coupling opening having slightly smaller dimensions, the plug-in section, which has larger dimensions and which lags in the plug-in direction, interacting with a section, which has correspondingly slightly larger dimensions, in the accommodating opening (coupling device). The inner press-in zone produces optimum contact between the outer conductor inner side and the coupling inner side, which may, for example, at the same time also represent the inner side of a housing part or a housing. The outer press-in zone produces optimum contact between the outer conductor outer side and the coupling outer side, i.e. likewise, for example, again a housing outer side. As a result, in contrast to the prior art, two clear and optimal electrical contact connections are always realized between the plug-in device and the coupling device, i.e. between the plug-in element and the accommodating opening.

In this case, a sleeve-like plug-in element is preferably used which is made of a material which is harder than the material of the coupling device, i.e., for example, the material of a plate, wall, housing wall or generally of a housing etc. with which contact is to be made and into which the accommodating opening is introduced for the purpose of accommodating the plug-in element. However, it is preferably intended for the material of the sleeve-like plug-in element to have the same, or at least a similar, coefficient of thermal expansion as the material of the coupling device.

An axial knurl or a transverse knurl is preferably provided. The knurl teeth can in this case be formed with tips, in which case they are preferably provided with insertion slopes at their leading end. These insertion slopes serve the purpose of preventing chipping during the press connection procedure.

The overall mode of operation is preferably such that the knurl tips of the plug-in connection element make notches in the housing material of the coupling element, which interacts with said plug-in connection element and which is generally in the form of a socket. As a result, there is elastic and plastic deformation of the corresponding material. In turn, this results in an excellent force-fitting connection. Owing to the elastic deformation component, the explained connection can thus also be used in the case of thermal cycling, and it is not necessary to form an interlocking connection of the plug-in element such that it is fixed in position.

The entire system can preferably be adapted such that both outer knurls at the same time make contact with corresponding material holes in the coupling device. This makes it easier to center and align the sleeve prior to pressing-in.

In principle, it is also possible for the system to be adapted such that, for example, initially the leading press-in section of the electrical plug-in connection elements comes into contact with the corresponding accommodating section in the coupling element and then, only after an albeit small axial press-in movement of the lagging second press-in section, comes into contact with the outer accommodating section, having larger dimensions, of the coupling device, or vice versa.

In principle, it is in addition also possible for the corresponding knurls to be provided on the inner surfaces of the coupling element which then interacts with possibly smooth outer circumferential surfaces on the at least two-stage plug-in element.

The defined contact situations which are markedly improved in accordance with the invention both in the inner and in the outer plug-in connection region result owing to the fact that the number of contacts is the same as the number of knurl tips. The contacts are preferably evenly distributed over the circumference. Furthermore, gas-tight, metallic end contacts can be realized, since oxide layers are destroyed by the sliding movement when pressing-in and, at the same time, a self-cleaning process also takes place.

In one development of the invention, provision may be made for the section acting as the stop to hit against a correspondingly shaped stop section in the coupling device, which is in the interior of the coupling device, between the leading plug-in section having smaller dimensions and the lagging plug-in section which is provided with a larger diameter. If the coupling device is, for example, formed in an electrically conductive housing wall, the inner stop lies in the inner section of the housing wall. This results in optimum assembly conditions, since the pressing-in procedure can be ended simply by means of force limitation. Finally, as a result even higher bending stresses of the preferably sleeve-like plug-in connection elements are possible. Owing to the stop limitation realized in the interior of the coupling, it is also not possible for any dust particles to penetrate the housing or the coupling device.

Owing to this formation, it is also possible for the diameter of a pressing-in die used to have the same dimensions or even to have smaller dimensions than the diameter of the preferably sleeve-like plug-in connection device. This is because the axial advance movement is limited by the mentioned stepped stop. This ensures that the coupling device or the housing is not partially pressed in during the pressing-in procedure and that impressions of the die are not visible after the assembly process.

Finally, the axial length of the preferably sleeve-like plug-in element, which is also sometimes referred to below as the plug-in connection element, is dimensioned such that the height of the press-in section corresponds to the height or the axial physical length of the coupling device, which is advantageous in particular when the coupling device is part of a plate or housing wall with which contact is to be made. Since high-frequency alternating currents flow on the surface of conductors owing to the skin effect, optimum current flow towards the inner side and the outer side of the housing wall or the like, which is provided with the accommodating opening, is thus realized.

It has also proved to be favorable if at least a small circumferential groove is provided between the two press-in sections on the electrical plug-in connection element. This makes it possible, for example, for the knurl structure to be cut cleanly into the outer circumferential regions of the two press-in sections. This also makes it possible to produce a clearly defined, stepped stop surface between the press-in sections.

Finally, it is also possible for a protrusion to be formed over the press-in section of the plug-in element which has larger dimensions, said protrusion preventing solder from being able to flow onto the two press surfaces when the cable is connected to the preferably sleeve-like plug-in connection device by means of soldering.

Naturally, the sleeve-like plug-in element may be soldered to the outer conductor of a coaxial cable before it is pressed into the coupling device. However, it is likewise also possible for there to be a pressing-in procedure into the coupling device in order in this case then to solder the electrical conductor, in particular the outer conductor of a coaxial cable, in a second step.

The multi-stage connection device according to the invention may particularly advantageously be used if the coupling element is intended to be produced by means of casting and if it needs to be provided with beveled deformations.

Figure 5:
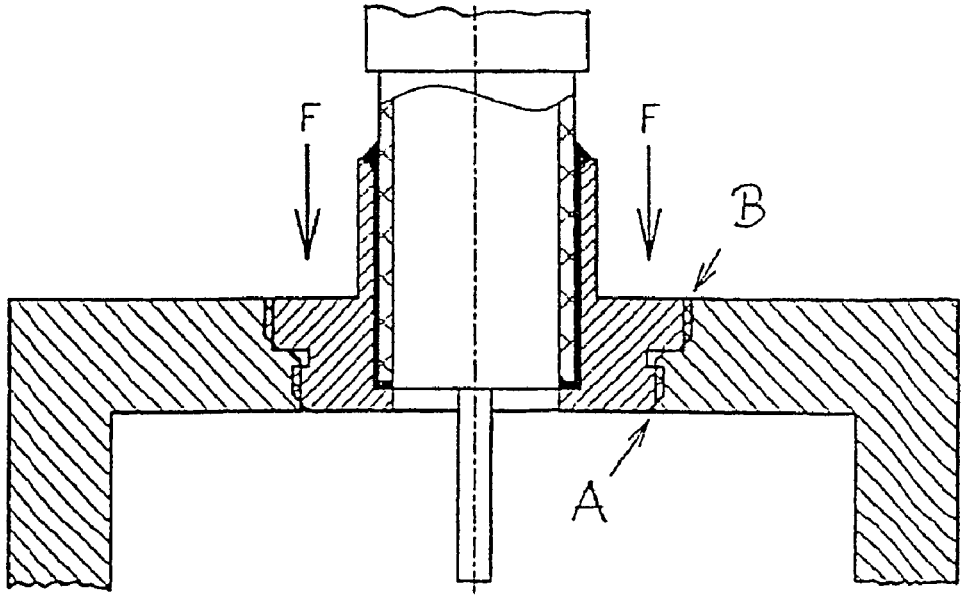
Figure 2:
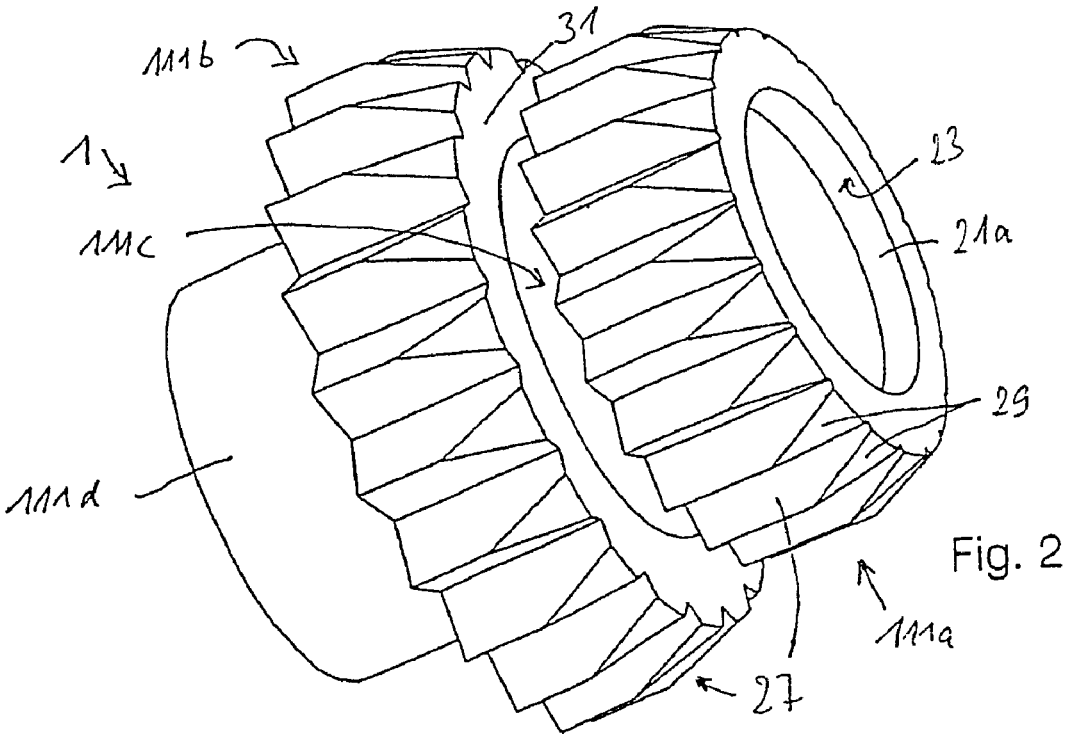
Figure 3:
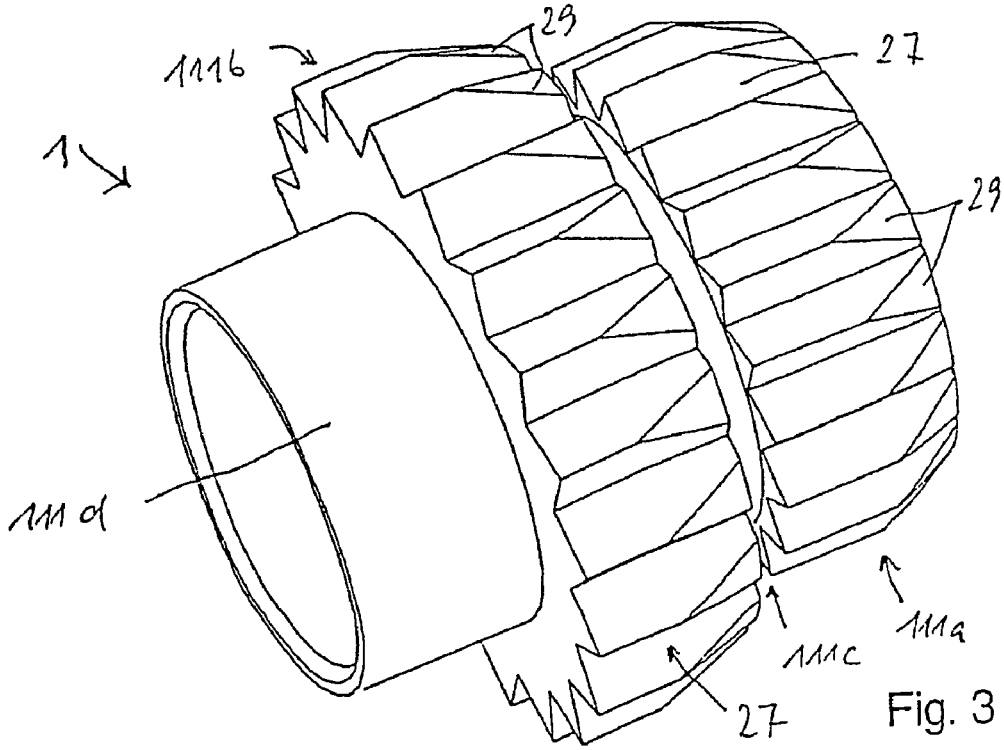
Figure 4:
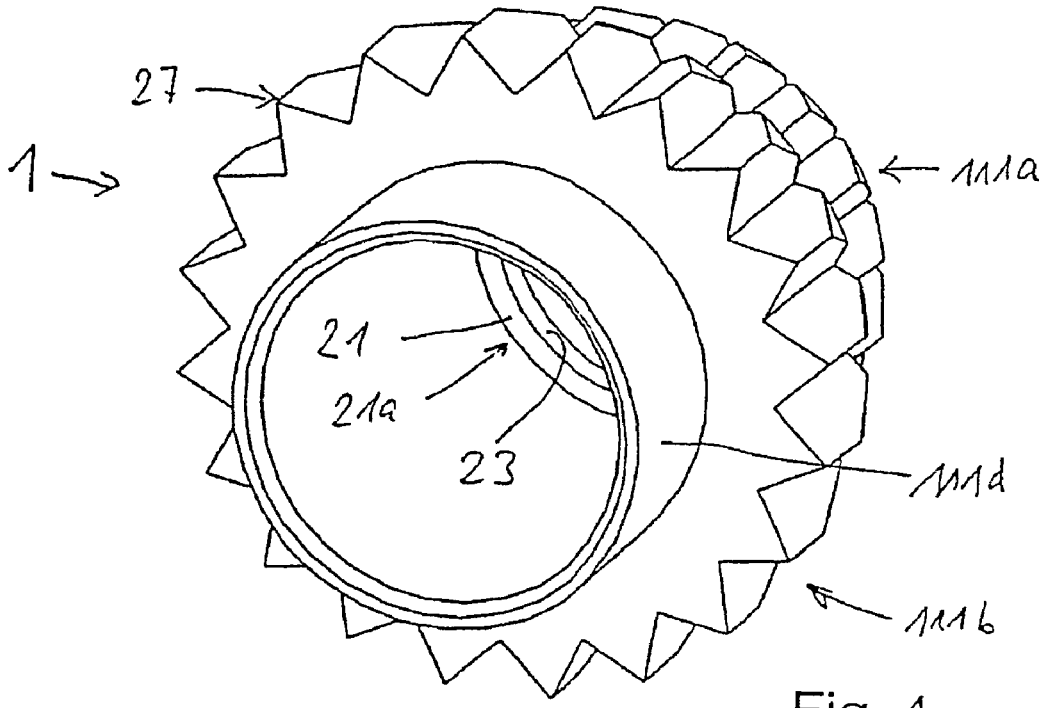
Figure 6:
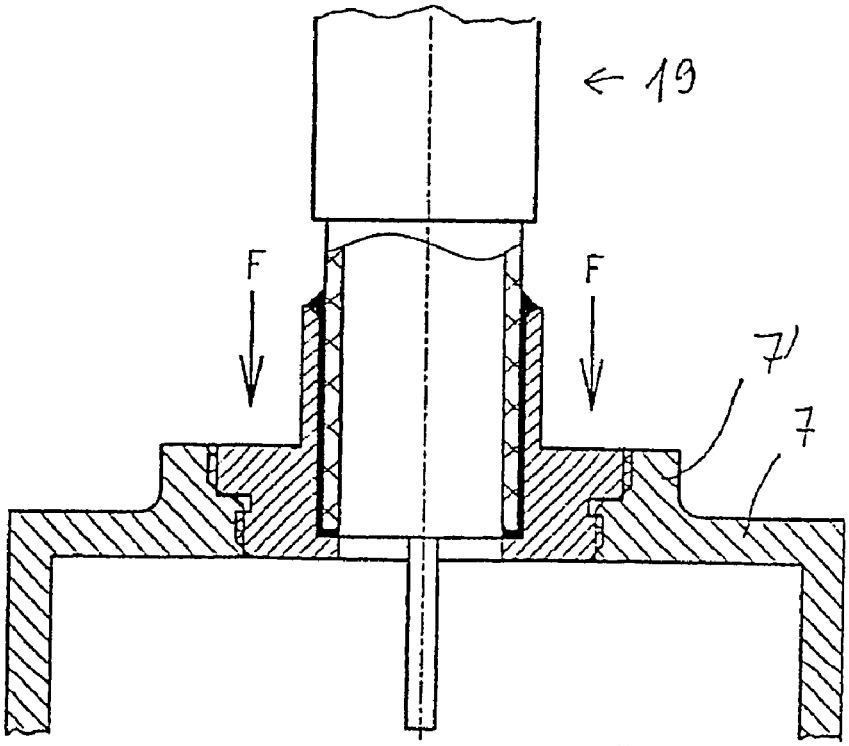
Figure 7:
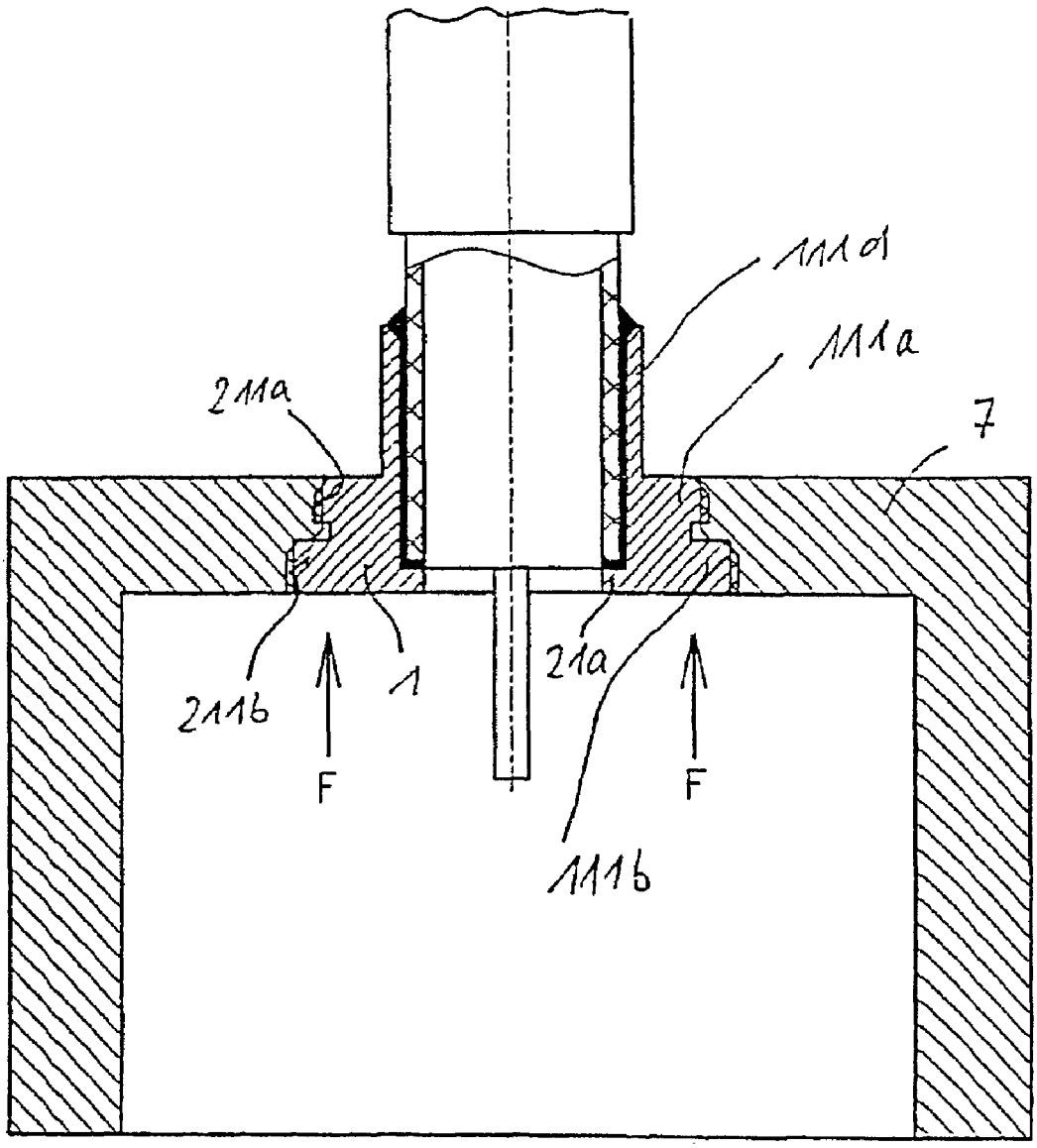
Figure 8:
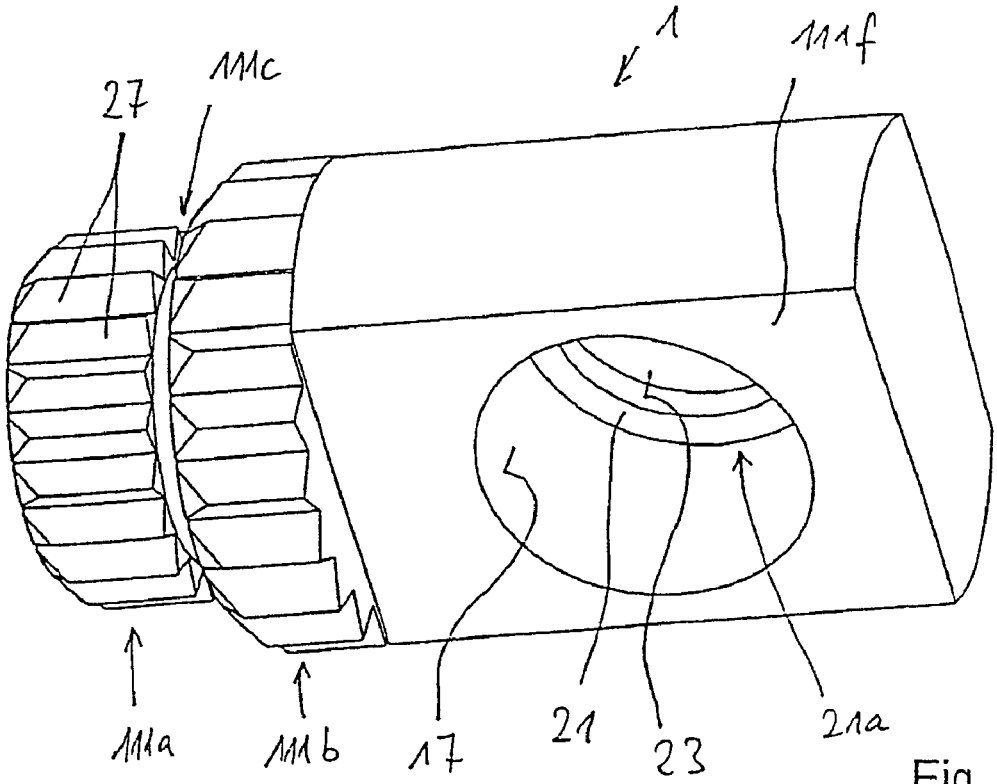
Figure 9:
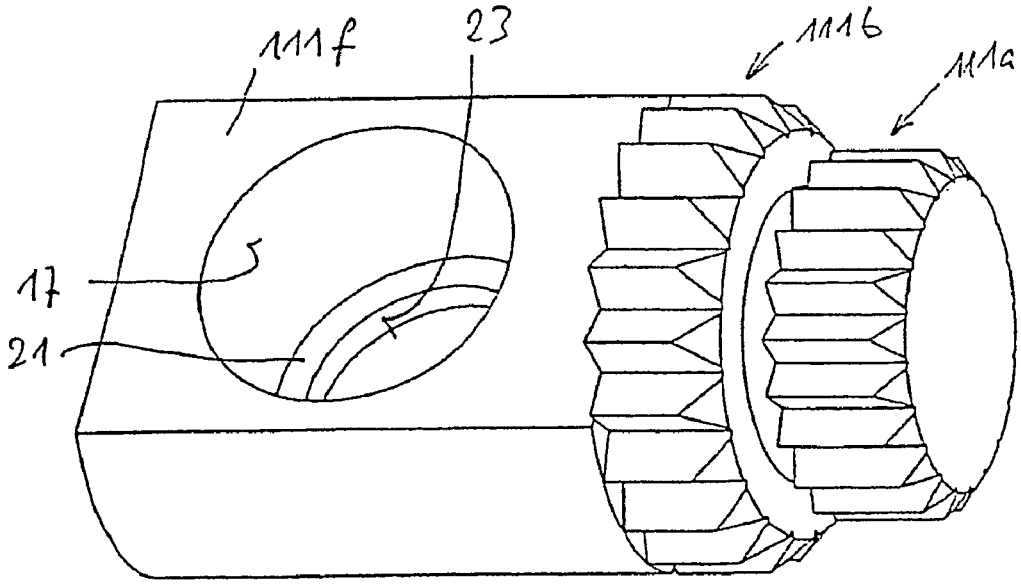
Figure 10:
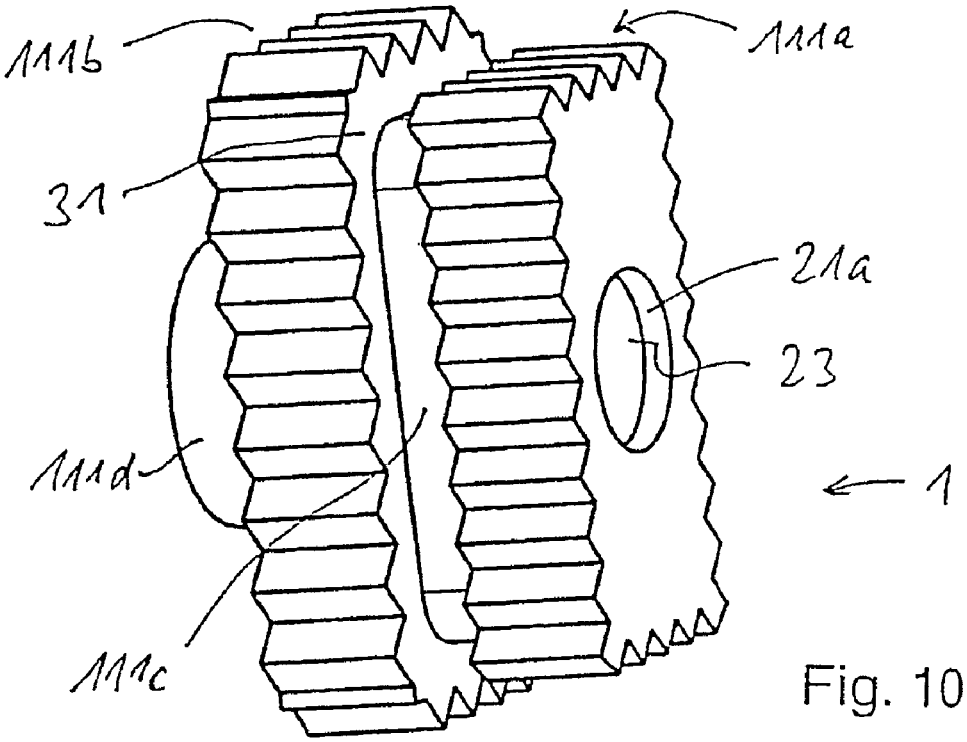
Figure 11:
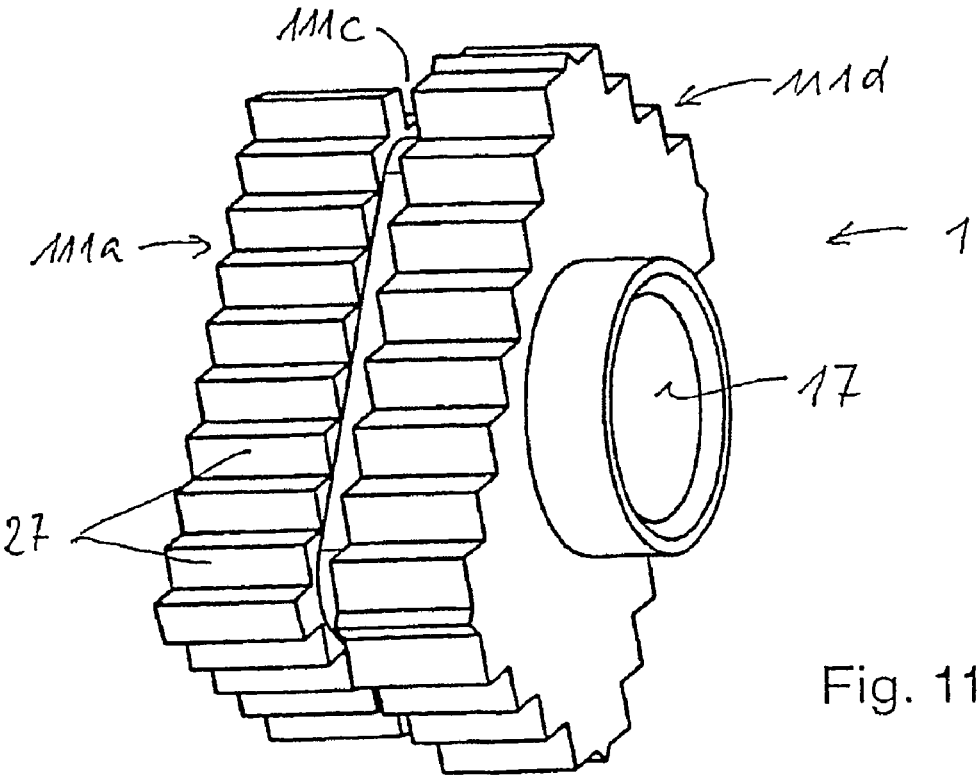

The invention will be explained in more detail below with reference to exemplary embodiments. In the drawing:

FIG. 1: shows a schematic cross-sectional illustration through a first exemplary embodiment according to the invention having a sleeve-like plug-in element (positioned on a section of an outer conductor of a coaxial cable from which the insulation has been stripped) and an accommodating opening (coupling device) formed in a housing wall prior to the press connection;

FIG. 2: shows a schematic perspective illustration of a preferred embodiment of a sleeve-like plug-in element;

FIG. 3: shows a corresponding schematic perspective illustration of the sleeve-like plug-in element shown in FIG. 2, but viewed more from the rear;

FIG. 4: shows a further perspective illustration, but at a viewing angle more from the rear compared with that in FIG. 3;

FIG. 5: shows an illustration corresponding to that in FIG. 1 once the press connection is complete;

FIG. 6: shows a modified exemplary embodiment to that shown in FIG. 5, in the case of which the accommodating opening (coupling device) is formed on a thicker housing section;

FIG. 7: shows an exemplary embodiment, which is modified compared to that shown in FIGS. 1 to 5, in the case of which the two-stage plug-in element can be inserted from the opposite side into the accommodating opening (coupling device) which is formed on the housing wall;

FIG. 8: shows an exemplary embodiment, which is modified compared to that shown in FIGS. 1 to 5, in the case of which the plug-in element with its two-stage press attachment does not have an axial hole passing through it for the purpose of accommodating an electrical connection line, in particular coaxial connection line, but has an accommodating hole, which extends perpendicular thereto, in an accommodating section;

FIG. 9: shows an illustration corresponding to that in FIG. 8, but more in the direction of the front side of the sleeve-like plug-in element;

FIG. 10: shows a perspective illustration of a modified exemplary embodiment having a more rectangular basic shape; and FIG. 11: shows a corresponding illustration to that in FIG. 10 with a perspective view, but viewed more from the rear.

A first exemplary embodiment will be explained below with reference to FIGS. 1 to 5.

FIG. 1 shows a schematic cross section of a coaxial terminal connection, which comprises, firstly, a plug-in element 1 and, secondly, a coupling device 3, which in the exemplary embodiment shown is in the form of a two-stage hole in a wall 7, i.e. an electrically conductive housing wall 7 or a wall 7 forming part of a housing.

The plug-in element 1 is in this case in the form of a sleeve and has an actual plug-in insert 111, which comprises a leading plug-in section 111*a* and a second plug-in section 111*b* which lags in the plug-in direction. The two plug-in sections 111*a* and 111*b* are provided such that they are offset with respect to one another in the plug-in direction, i.e. in the axial direction, by the width of an annular groove 111*c*. The annular groove 111*c* in this case has a smaller diameter than the two outer diameters of the plug-in inserts 111*a* and 111*b*.

The illustration shown in FIGS. 1 to 5 shows the fact that the plug-in element 1 is formed with a sleeve attachment 111*d*, which is formed such that it extends axially, on the side 1*a* which is at the rear with respect to the plug-in direction.

The plug-in element 1 has an inner hole 17, which is at least slightly larger than the outer diameter of an outer conductor 19*a*, from which the insulation has been stripped, of a coaxial cable 19. The axial length of the inner hole 17 almost passes through the entire axial length of the plug-in element 1, except for a stop shoulder 21 having a hole 23 having a slightly smaller diameter than the inner hole 17. This stop shoulder 21 having the annular attachment 21*a* formed thereby is thus formed on the end side 1*b* which lies at the front in the plug-in direction. As a result, the coaxial cable 19, from which the insulation has been stripped away down to the outer conductor 19*a*, can be inserted into the plug-in element 1 until it stops against the stop shoulder 21. Before the further connection to the accommodating opening 3 or else after the connection to the coupling device 3 has been produced, a soldering procedure can then be carried out in order to effectively electrically conductively connect the outer conductor 19*a* to the electrically conductive plug-in element 1 by means of the solder 25. The corresponding inner conductor 19*b* finally passes through the plug-in element 1 at a suitable length, as is illustrated, for example, in FIG. 1. In this case, it can also be seen from the drawings that the hole 23 is dimensioned such that the inner conductor 19*b* of the coaxial cable 19 can be passed through it without any problems and plugged in, without, in the finally positioned state of the inner conductor, electrical contact being made with the plug-in element 3.

As can be seen in FIGS. 2 to 4, the plug-in section 111*a* lying at the front in the plug-in direction has a smaller outer diameter than the second plug-in section 111*b* which lags in the plug-in direction. The two plug-in sections are provided on their outer circumference with a knurl 27, for example an axial knurl or a transverse knurl etc., whose outer diameter, before the connection to the coupling device 3, is at least slightly larger than the corresponding inner diameter of the coupling device 3 which is yet to be explained below.

As can be seen in FIG. 1 with reference to the exemplary embodiment, the coupling device 3, which is in this case incorporated in the form of an electrical housing wall 7, is likewise of two-stage design and has a first accommodating section 211*a* having a smaller diameter and a second accommodating section 211*b*, which lies offset with respect thereto in the axial direction, having a larger diameter. The two diameters or the two shapes and sizes of the accommodating plug-in sections 211*a* and 211*b* are matched in principle to the shape and size of the two plug-in sections 111*a* and 111*b*, which are likewise offset, and differ only in the fact that the outer circumference on the plug-in attachments is slightly larger than the respectively associated accommodating sections 211*a* and 211*b* owing to the knurl 27 which is introduced at said plug-in attachments before they are inserted into the accommodating opening 3 (coupling device). The core diameters of the plug-in sections provided with a knurl are, however, smaller than the corresponding inner diameters of the accommodating opening 3, with the result that after pressing-in, contact is only made with the knurl tips, and only low joining forces are required even in the case of very large dimensions. Owing to the introduction of the circumferential annular groove 111*c*, advantages in terms of manufacturing result when the knurl 27 formed on the outer circumference is produced. In the lead direction, in this case the respective knurl 27 is in each case provided with a flattened section 29 in order to prevent chipping during assembly. The surface 31, which points towards the front in the plug-in direction, of the plug-in section 111*b* having larger dimensions in this case at the same time acts as a stop surface or stop shoulder 31, which is formed on a corresponding stop surface or stop shoulder 33 at the transition from the accommodating section 211*a* having smaller dimensions to the accommodating section 211*b* having larger dimensions of the accommodating opening 3.

In order to produce the fixed connection, the plug-in element 1 is then pressed into the accommodating opening 3, which is sometimes also referred to as the coupling element 3, by means of a suitable pressing tool (which may have smaller dimensions than the diameter of the plug-in section 111*b* having larger dimensions), the outwardly protruding teeth of the knurls 27 now forming notches in the material of the housing wall 7. Owing to the sliding movement, possible oxide layers are destroyed, and a self-cleaning effect takes place which ensures optimal contact-making without electrical faults.

The two-stage contact mechanism ensures that currents can flow back and forth both from the inner and from the outer side of the coaxial cable outer conductor (in particular if it is located in an electromagnetic field) in a clearly defined manner to the housing wall 7, that is to say both via the contact region A between the leading plug-in section 111*a* in interaction with the accommodating section 211*a* and also via the further interaction in the contact region B between the second plug-in section 111*b* which is formed such that it lags in the plug-in direction and the accommodating section 211*b*.

The in each case uniquely defined electrical contact zones are identified by A and B in FIG. 5.

Naturally, a plurality of inner holes 17 may also be provided on the plug-in element 1 for the purpose of accommodating coaxial cables.

The exemplary embodiment shown in FIG. 6 differs from the previous exemplary embodiment only by the fact that the wall section 7 is provided with a thicker section of material 7' in the region of the accommodating opening 3 compared with the remaining housing or wall sections 7.

With reference to exemplary embodiment 7, it is merely shown that the arrangement of the axially offset plug-in sections 111*a* and 111*b* and the associated accommodating sections 211*a* and 211*b* of the accommodating opening 3 may also be formed in the opposite fashion to that shown in the exemplary embodiment shown in FIGS. 1 and 5. In the exemplary embodiment shown in FIG. 7, the plug-in element 1 is introduced into the corresponding recess from the inner side of the housing. In this case, the soldered connections between the plug-in element 1 and the coaxial cable can be produced once the press connection between the plug-in element 1 and the coupling device 3 has been produced or even beforehand. In this case, the cable needs to be passed through the coupling opening 211 before pressing-in.

In the exemplary embodiment shown in FIG. 8, it is shown that the plug-in element 1 does not need to be in the form of a sleeve but that the corresponding inner hole 17 can also be formed transversely with respect to the axial direction of the plug-in attachments 111*a* and 111*b* in a rear section 111*f* of the plug-in element 1 so as to form a stop shoulder 21. It is also possible for knurls to be provided at both ends of the plug-in element, and for contact to be made with said plug-in element and, at the same time, two parallel housing walls.

With reference to FIGS. 10 and 11, it is also shown that the plug-in element 1 does not necessarily need to approximate a circular shape in the axial view. Elliptical shapes, rectangular shapes or generally n-polygonal or other basic shapes are also conceivable. In this case, the accommodating sections 211*a* and 211*b* of the coupling device 3 would also have to have a corresponding shape. In this embodiment too, it is the case that the circumferential contour or cross-sectional surface, viewed in the axial or plug-in direction, or the cross-sectional size of the plug-in attachment 111*a*, which leads in the plug-in direction, is preferably overall smaller than the cross-sectional sizes of the second plug-in attachment 111*b,* which lags in the plug-in direction. Under certain circumstances, it would also be sufficient, however, for the leading plug-in section 111*a* to have smaller dimensions than the lagging plug-in section 111*b,* at least in a cross-sectional extent. In addition, the cross-sectional shapes of the two plug-in sections may be different, for example the leading plug-in section may be of rectangular design, cf. FIG. 10, whereas the lagging plug-in section having larger dimensions again has more of a circular cross-sectional shape, for example.

For reasons of completeness, mention will also be made of the fact that the mentioned knurls 27 do not necessarily need to be formed on the outer circumference of the two plug-in sections, but, quite the reverse, may also be formed on the inner wall, interacting therewith, of the two accommodating sections 211*a* and 211*b* or, alternately, on the outer circumference of one plug-in section and on the inner surface of a second accommodating section, which is offset with respect thereto, of the coupling device.

It can also be seen in the drawings that the respective axial height of the plug-in sections corresponds to the axial heights of the accommodating sections of the coupling device. As a result, in each case the limit surface which leads in the plug-in direction and the outer limit surface which lags in the plug-in direction are arranged such that they are aligned with the inner and outer housing wall sections.

The invention claimed is:

1. An electrical terminal connection, for connecting an outer conductor of a coaxial cable, comprising a housing including a wall; a plug-in elements which has a sleeve attachment for accommodating and connecting an electrical conductor of the coaxial cable, the housing wall having an accommodating opening, which interacts with the plug-in element thereof, the plug-in element being pressed into the accommodating opening for the purpose of making an electrical connection to the housing wall, wherein the electrical terminal connection is designed to have two stages, the plug-in element having at least two plug-in sections which are formed such that they are offset in the plug-in direction, both the plug-in section which leads in the plug-in direction and the plug-in section which lags in the plug-in direction each being provided with a knurl on their outer circumference, a second accommodating opening having a first and a second accommodating section which lie such that they are offset in the plug-in direction of the plug-in element, and the two plug-in sections and the two accommodating sections, complementary thereto, being designed to have differing cross-sectional sizes, the radial or outer dimension of the plug-in sections, which are provided with the knurl, being slightly greater than the radial or outer dimension of the accommodating sections respectively interacting therewith.

2. The terminal connection as claimed in claim 1, wherein the leading plug-in section has a cross-sectional dimension in a circumferential region transverse to the plug-in direction of the plug-in element that is smaller than a corresponding cross-sectional dimension of the lagging plug-in section.

3. The terminal connection as claimed in claim 1, wherein the cross-sectional size of the leading plug-in section is smaller than the cross-sectional size of the lagging plug-in section in the entire circumferential region and transverse to the plug-in direction of the plug-in element.

4. The terminal connection as claimed in claim 2, wherein the first accommodating section of the accommodating opening has a dimension in a circumferential region that is smaller than a corresponding dimension in the offset, second accommodating section.

5. The terminal connection as claimed in claim 3, wherein the first accommodating section of the accommodating opening is smaller than the offset, second accommodating section in the entire circumferential region corresponding to the circumferential region of the plug-in section interacting therewith.

6. The terminal connection as claimed in claim 1, wherein the inner surfaces of the accommodating sections of the accommodating opening are designed to have no knurls.

7. The terminal connection as claimed in claim 1, wherein, of the outer circumferential surfaces of a plug-in section which each interact in pairs and the inner surface of the associated accommodating section of the accommodating opening, in each case only one section is formed with a knurl and the other surface interacting therewith is formed without a knurl.

8. The terminal connection as claimed in claim 1, wherein the knurl is in the form of an axial knurl or in the form of a transverse knurl.

9. The terminal connection as claimed in claim 1, wherein the knurl is provided with leading flattened sections in the plug-in direction.

10. The terminal connection as claimed in claim 1, wherein a circumferential annular groove arranged therebetween is provided between the two outer circumferential surfaces of the plug-in sections.

11. The terminal connection as claimed in claim 1, wherein a surface, which leads in the plug-in direction, of the lagging plug-in section of the plug-in element acts as a stop shoulder which interacts with a corresponding stop surface between the first and second accommodating section of the accommodating opening.

12. The terminal connection as claimed in claim 1, wherein the entire axial plug-in height of the plug-in attachment corresponds to the axial accommodating height of the accommodating opening such that, once the pressing-in procedure has been carried out, the plug-in insert which has been pressed into the accommodating opening ends flush with the housing wall both on the inside and on the outside.

13. The terminal connection as claimed in claim 1, wherein the cross-sectional shape of the plug-in sections of the plug-in element and the accommodating sections, interacting therewith, of the accommodating opening are circular or n-polygonal.

14. The terminal connection as claimed in claim 1, wherein the plug-in element or housing wall provided with the knurl is made of a harder material than the housing wall or plug-in element interacting therewith.

15. The terminal connection as claimed in claim 1, wherein the sleeve attachment of the of plug-in element is arranged axially, counter to the plug-in direction, on the lagging plug-in section for the purpose of connecting the coaxial cable.

16. The terminal connection as claimed in claim 1, wherein the sleeve attachment of the plug-in element is arranged axially, in the plug-in direction, on the leading plug-in section for the purpose of connecting the coaxial cable.

17. The terminal connection as claimed in claim 1, wherein a plurality of internal holes are formed on the plug-in element for the purpose of accommodating coaxial cable.

* * * * *